US007809560B2

(12) United States Patent
Yen et al.

(10) Patent No.: US 7,809,560 B2
(45) Date of Patent: Oct. 5, 2010

(54) METHOD AND SYSTEM FOR IDENTIFYING SPEECH SOUND AND NON-SPEECH SOUND IN AN ENVIRONMENT

(75) Inventors: Chia-Shin Yen, Taipei (TW); Chien-Ming Wu, Taipei (TW); Che-Ming Lin, Taipei (TW)

(73) Assignee: Panasonic Corporation, Osaka (JP)

( * ) Notice: Subject to any disclaimer, the term of this patent is extended or adjusted under 35 U.S.C. 154(b) by 731 days.

(21) Appl. No.: 11/814,024

(22) PCT Filed: Jan. 26, 2006

(86) PCT No.: PCT/JP2006/301707

§ 371 (c)(1),
(2), (4) Date: Jul. 16, 2007

(87) PCT Pub. No.: WO2006/082868

PCT Pub. Date: Aug. 10, 2006

(65) Prior Publication Data

US 2009/0070108 A1 Mar. 12, 2009

(30) Foreign Application Priority Data

Feb. 1, 2005 (CN) ..... 2005 1 0006463

(51) Int. Cl.
*G10L 21/02* (2006.01)

(52) U.S. Cl. ..... 704/233; 704/214; 704/226; 381/94.2

(58) Field of Classification Search ..... 704/214, 704/226, 233; 381/94.2
See application file for complete search history.

(56) References Cited

U.S. PATENT DOCUMENTS

| | | | | |
|---|---|---|---|---|
| 4,882,755 | A * | 11/1989 | Yamada et al. | 704/239 |
| 4,979,214 | A * | 12/1990 | Hamilton | 704/233 |
| 6,427,134 | B1 | 7/2002 | Garner et al. | |
| 2002/0165681 | A1 * | 11/2002 | Yoshida et al. | 702/76 |
| 2003/0023430 | A1 * | 1/2003 | Wang et al. | 704/226 |
| 2005/0143978 | A1 * | 6/2005 | Martin et al. | 704/208 |

FOREIGN PATENT DOCUMENTS

CN 1225736 8/1999

(Continued)

OTHER PUBLICATIONS

English language Abstract of JP 2002-023776.

(Continued)

*Primary Examiner*—Daniel D Abebe
(74) *Attorney, Agent, or Firm*—Greenblum & Bernstein, P.L.C.

(57) ABSTRACT

In a method and system for identifying speech sound and non-speech sound in an environment, a speech signal and other non-speech signals are identified from a mixed sound source having a plurality of channels. The method includes the following steps: (a) using a blind source separation (BSS) unit to separate the mixed sound source into a plurality of sound signals; (b) storing spectrum of each of the sound signals; (c) calculating spectrum fluctuation of each of the sound signals in accordance with stored past spectrum information and current spectrum information sent from the blind source separation unit; and (d) identifying one of the sound signals that has a largest spectrum fluctuation as the speech signal.

8 Claims, 3 Drawing Sheets

FOREIGN PATENT DOCUMENTS

| | | |
|---|---|---|
| JP | 2002-023776 | 1/2002 |
| JP | 2004-145172 | 5/2004 |
| WO | 98/01847 | 1/1998 |
| WO | 01/17109 | 3/2001 |

OTHER PUBLICATIONS

Visser et al., "Blind source separation in mobile environments using a priori knowledge," Proceedings of IEEE International Conference on Acoustics, Speech, and Signal Processing, 2004 (ICASSP'04), Montreal, Quebec, Canada, May 17-21, 2004, Piscataway, NJ, USA, IEEE, vol. 3, May 17, 2004, pp. 893-896; XP010718334.

Jayaraman et al., "Blind source separation of acoustic mixtures using time-frequency domain independent component analysis," Proceedings of the 9th International Conference on Neural Information Processing, 2002 (ICONIP'02), Nov. 18-22, 2002, Piscataway, NJ, USA, IEEE, vol. 3, Nov. 18, 2002, pp. 1383-1387; XP010640643.

* cited by examiner

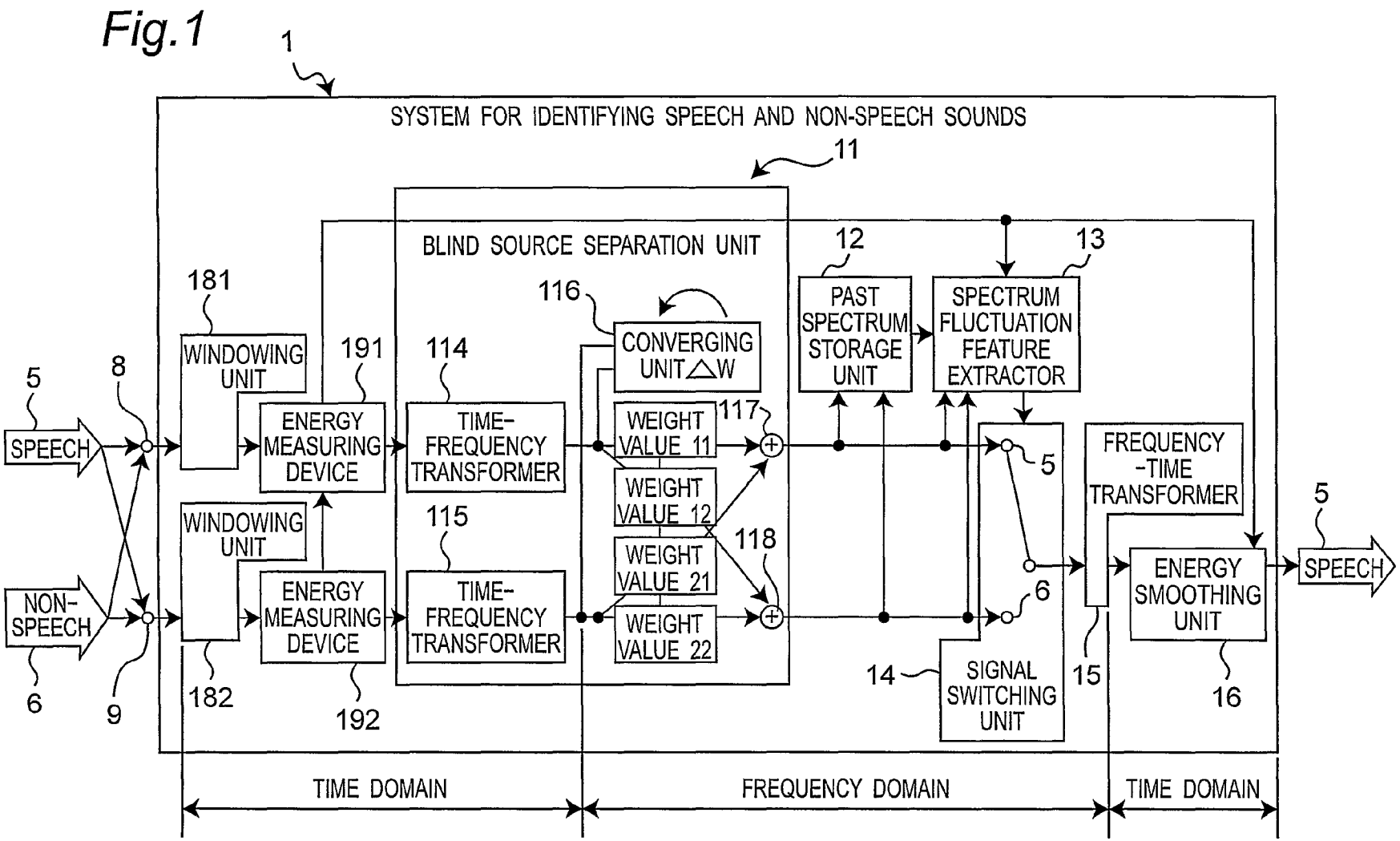
Fig.1
1
SYSTEM FOR IDENTIFYING SPEECH AND NON-SPEECH SOUNDS
11
BLIND SOURCE SEPARATION UNIT
CONVERGING UNIT △W
116
WEIGHT VALUE 11
WEIGHT VALUE 12
WEIGHT VALUE 21
WEIGHT VALUE 22
117
118
TIME-FREQUENCY TRANSFORMER
114
TIME-FREQUENCY TRANSFORMER
115
ENERGY MEASURING DEVICE
191
ENERGY MEASURING DEVICE
192
WINDOWING UNIT
181
WINDOWING UNIT
182
SPEECH
5
NON-SPEECH
6
8
9
PAST SPECTRUM STORAGE UNIT
12
SPECTRUM FLUCTUATION FEATURE EXTRACTOR
13
SIGNAL SWITCHING UNIT
14
FREQUENCY -TIME TRANSFORMER
15
ENERGY SMOOTHING UNIT
16
SPEECH
5
TIME DOMAIN
FREQUENCY DOMAIN
TIME DOMAIN

METHOD AND SYSTEM FOR IDENTIFYING SPEECH SOUND AND NON-SPEECH SOUND IN AN ENVIRONMENT

TECHNICAL FIELD

The invention relates to a method and system for identifying speech sound and non-speech sound in an environment, more particularly to a method and system for identifying speech sound and non-speech sound in an environment through calculation of spectrum fluctuations of sound signals.

BACKGROUND ART

Blind Source Separation (BSS) is a technique applied to separate a plurality of original signal sources from an output mixed signal under a condition that the original signal sources collected by a plurality of signal input devices (such as microphones) are unknown. However, the BSS technique cannot further identify the separated signal sources. For example, if one of the signal sources is speech, and the other of the signal sources is noise, the BSS technique can only separate these two signals from the output mixed signal, and cannot further identify which one is speech and which one is noise.

There are conventional techniques for further identifying which separated signal source is speech and which separated signal source is noise. For instance, in Japanese Patent Publication Number JP2002023776, "Kurtosis" of a signal is utilized to identify if the signal is speech or noise. The technique of the publication is based on the facts that a noise signal has a normal distribution whereas a speech signal has a sub-Gaussian distribution. When the distribution of a signal becomes more normal, this represents that there is less Kurtosis. Hence, it is mathematically possible to use Kurtosis for identifying a signal.

However, in the real world, sounds not only have speech and random noise mixed therein, but also include other non-speech sounds, such as music. Since these non-speech sounds, such as music, do not have a normal distribution, they cannot be distinguished from speech sounds using Kurtosis features of signals.

DISCLOSURE OF INVENTION

Therefore, an object of the present invention is to provide a method for identifying speech sound and non-speech sound in an environment that can identify a speech signal and other non-speech signals from a mixed sound source having a plurality of channels, and that involves only one set of calculations for transforming signals from the frequency domain to the time domain.

According to one aspect of the present invention, there is provided a method for identifying speech sound and non-speech sound in an environment. The method comprises the steps of: (a) using a blind source separation unit to separate a mixed sound source into a plurality of sound signals; (b) storing spectrum of each of the sound signals; (c) calculating spectrum fluctuation of each of the sound signals in accordance with stored past spectrum information and current spectrum information sent from the blind source separation unit; and (d) identifying one of the sound signals that has a largest spectrum fluctuation as a speech signal.

Another object of the present invention is to provide a system for identifying speech sound and non-speech sound in an environment that can identify a speech signal and other non-speech signals from a mixed sound source having a plurality of channels, and that performs only one set of calculations for transforming signals from the frequency domain to the time domain.

According to another aspect of the present invention, there is provided a system for identifying speech sound and non-speech sound in an environment. The system comprises a blind source separation unit, a past spectrum storage unit, a spectrum fluctuation feature extractor, and a signal switching unit. The blind source separation unit is for separating a mixed sound source into a plurality of sound signals. The past spectrum storage unit is for storing spectrum of each of the sound signals. The spectrum fluctuation feature extractor is for calculating spectrum fluctuation of each of the sound signals in accordance with past spectrum information sent from the past spectrum storage unit and current spectrum information sent from the blind source separation unit. The signal switching unit is for receiving the spectrum fluctuations sent from the spectrum fluctuation feature extractor, and for identifying one of the sound signals that has a largest spectrum fluctuation as a speech signal.

BRIEF DESCRIPTION OF DRAWINGS

Other features and advantages of the present invention will become apparent in the following detailed description of the preferred embodiment with reference to the accompanying drawings, of which:

FIG. 1 is a system block diagram of the preferred embodiment of a system for identifying speech sound and non-speech sound in an environment according to the present invention;

BEST MODE FOR CARRYING OUT THE INVENTION

Figure 2:
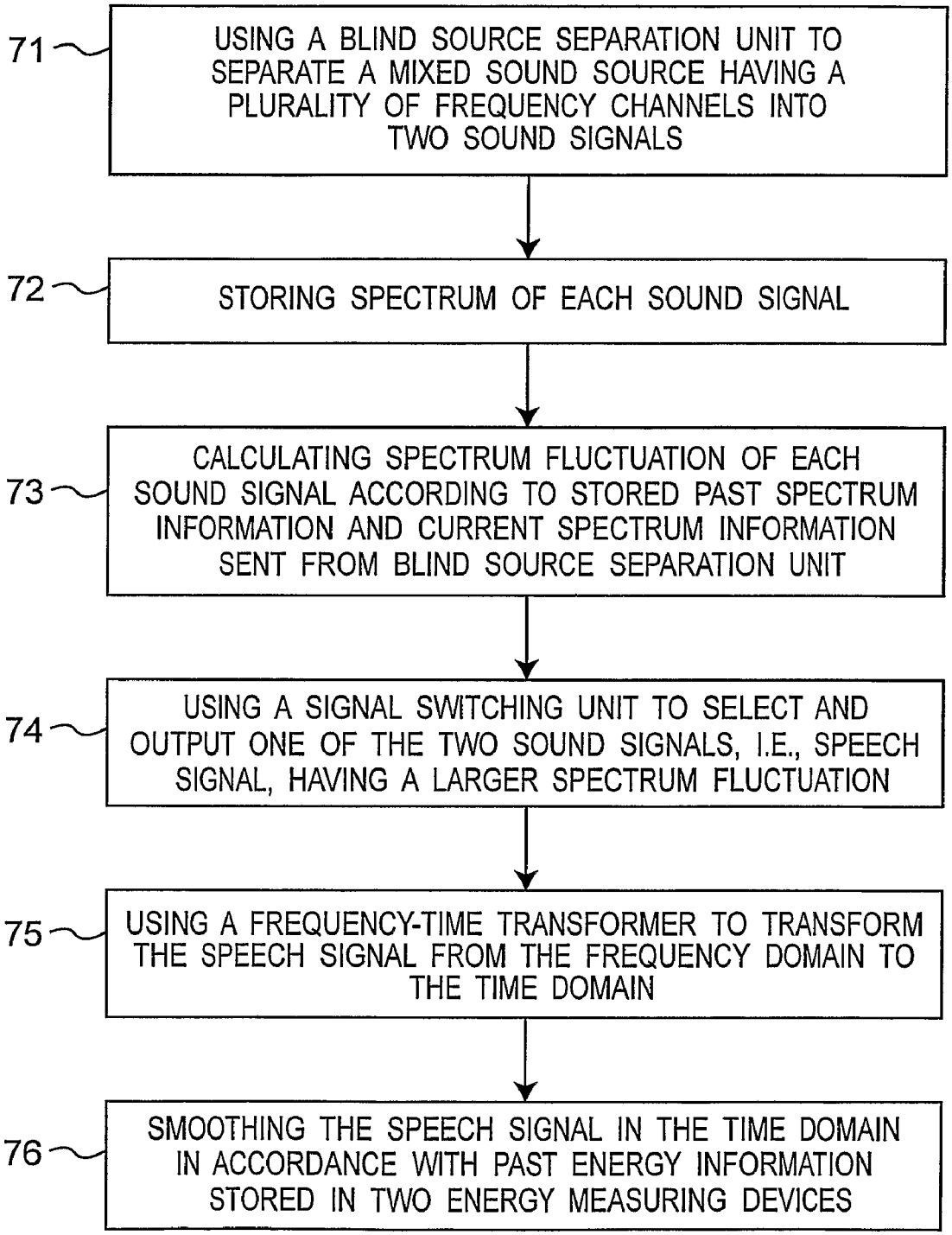
FIG. 2 is a flowchart to illustrate the preferred embodiment of a method for identifying speech sound and non-speech sound in an environment according to the present invention.

The method and system for identifying speech sound and non-speech sound in an environment according to the present invention are for identifying a speech signal and other non-speech signals from a mixed sound source having a plurality of channels. The channels of the mixed sound source can be, for example, those respectively collected by a plurality of microphones, or a plurality of sound channels (such as left and right sound channels) stored in an audio compact disc (audio CD).

Referring to FIG. 1, in the preferred embodiment of the method and system 1 of this invention, the aforesaid mixed sound source includes sound signals collected by two microphones 8 and 9. The original sound signals collected by the two microphones 8 and 9 from the environment include a speech sound 5 representing human talking sounds, and a non-speech sound 6, such as music, representing sounds other than the speech sound 5. Since the speech sound 5 and the non-speech sound 6 will be collected by the two microphones 8 and 9 simultaneously, the system 1 of this invention is needed to separate the speech sound 5 from the non-speech sound 6, and to identify which one is the speech sound 5 for subsequent applications.

The system 1 includes two windowing units 181, 182, two energy measuring devices 191, 192, a blind source separation unit 11, a past spectrum storage unit 12, a spectrum fluctuation feature extractor 13, a signal switching unit 14, a frequency-time transformer 15, and an energy smoothing unit 16. The blind source separation unit 11 includes two time-frequency transformers 114, 115, a converging unit ΔW 116, and two adders 117, 118. When the two time-frequency transformers 114, 115 are based on Fast Fourier Transformations (FFT), the frequency-time transformer 15 should be based on Inverse Fast Fourier Transformations (IFFT). On the other hand, when the two time-frequency transformers 114, 115 are based on Discrete Cosine Transformations (DCT), the frequency-time transformer 15 should be based on Inverse Discrete Cosine Transformations (IDCT).

Referring to FIG. 2, the preferred embodiment of the method of this invention begins, as shown in step 71, by using the blind source separation unit 11 to separate a mixed sound source collected by the two microphones 8, 9 into two sound signals. At this time, which one of the two sound signals is a speech sound 5 and which one of the two sound signals is a non-speech sound 6 are not yet identified.

Details of the step 71 are provided as follows: First, the two channels of the mixed sound source collected by the microphones 8, 9 are inputted into the two windowing units 181, 182, respectively. Subsequently, through the windowing performed in the corresponding windowing unit 181, 182, each frame of sound of the two channels is multiplied by a window, such as a Hamming window, and is then transmitted to a corresponding one of the energy measuring devices 191, 192. Next, the two energy measuring devices 191, 192 are used to measure energy of each frame for subsequent storage in a buffer (not shown). The energy measuring devices 191, 192 can provide reference amplitudes for output signals such that output energy can be adjusted in order to smoothen the output signals. Then, signal frames are sent to the time-frequency transformers 114, 115. The time-frequency transformers 114, 115 are used to transform each frame from the time domain to the frequency domain. Subsequently, the converging unit ΔW 116 uses frequency domain information to converge each of weight values W11, W12, W21, W22. Thereafter, through multiplication with the weight values W11, W12, W21, W22, each signal can be adjusted before subsequent addition using the adders 117, 118.

The feature of this invention resides in that, by using the past spectrum storage unit 12, the spectrum fluctuation feature extractor 13, and the signal switching unit 14, spectrum fluctuation of each sound signal can be calculated. The sound signal having a largest spectrum fluctuation is then identified as the speech sound 5.

Thereafter, as shown in step 72, the past spectrum storage unit 12 is used to store spectrum of each of the sound signals.

Subsequently, as shown in step 73, the spectrum fluctuation feature extractor 13 refers to past spectrum information stored in the past spectrum storage unit 12, current spectrum information sent from the blind source separation unit 11, and past energy information sent from the energy measuring devices 191, 192 so as to calculate spectrum fluctuation of each of the sound signals according to the following equation (1).

Through careful study of characteristics of speech sound and non-speech sound, such as music, a useful feature, i.e., spectrum fluctuation, was found to be suitable for identifying what kind of sound signal is most likely to be a speech sound. Spectrum fluctuation Θ(t,k) is defined by the following equation (1):

$$\partial(t,k) \equiv \log_{10}\left(\sum_{\tau=t}^{t-k}\sum_{n=4k}^{\text{sampling_rate}/2}\left|\frac{f(\tau,\ n-1)\times f(\tau,n)}{\sum_{m=1}^{\text{sampling_rate}/2}|f(\tau,m)|}\right|\right) \quad (1)$$

where frequency $$f(\tau,n) \equiv \text{abs}(FFT(x[n]))\,|_{n=\tau}^{n=\tau+\text{frame_size}-1},\ x[n]$$

is an original signal, and τ is Begin Of Frame. As for the definitions of other parameters in equation (1): k is duration, sampling_rate/2 is identifiable range of sound frequencies, f(τ,n−1)×f(τ,n) represents the relationship between adjacent frequency bands, and $$\sum_{m=1}^{\text{sampling_rate}/2}|f(\tau,m)|$$

is for normalization of frequency energy.

After calculating spectrum fluctuations of speech sound 5 and non-speech sound 6, such as music, according to the aforesaid equation (1), it was found that the spectrum fluctuation of speech sound 5 is larger than the spectrum fluctuation of music. Vowel sounds in the speech sound 5 will generate evident peak values on the spectrum, while fricative sounds in the speech sound 5 will cause abrupt changes on a spectrogram of continuous talking sounds. Since vowel sounds and fricative sounds are interleaved with each other in the speech sound 5, during a period of 30 ms at a frequency above 4 kHz (fricative sound), spectrum fluctuation of speech sound 5 will be larger than spectrum fluctuation of other non-speech sound 6.

After spectrum fluctuations of speech sound 5 and non-speech sound 6 have been respectively calculated in the spectrum fluctuation feature extractor 13, as shown in step 74, this invention can use the signal switching unit 14 to select and output one of the two sound signals, that is, the speech sound 5, having a larger spectrum fluctuation, which up to now is still in the frequency domain.

Next, as shown in step 75, the frequency-time transformer 15 is used to transform the speech sound 5 in the frequency domain back to the time domain. Therefore, compared to the conventional blind source separation technique that needs more than two sets of calculations for transforming signals from the frequency domain to the time domain, since only the identified speech sound 5 is required to be outputted in the present invention, only one set of calculations is required for transforming signals from the frequency domain to the time domain. In particular, since the non-speech sound 6 is not required to be outputted, there is no need to conduct frequency-time transformation calculations for the same.

Thereafter, as shown in step 76, in accordance with past energy information sent from the energy measuring devices 191, 192, the energy smoothing unit 16 can be used to smoothen the speech signal in the time domain.

Figure 3:
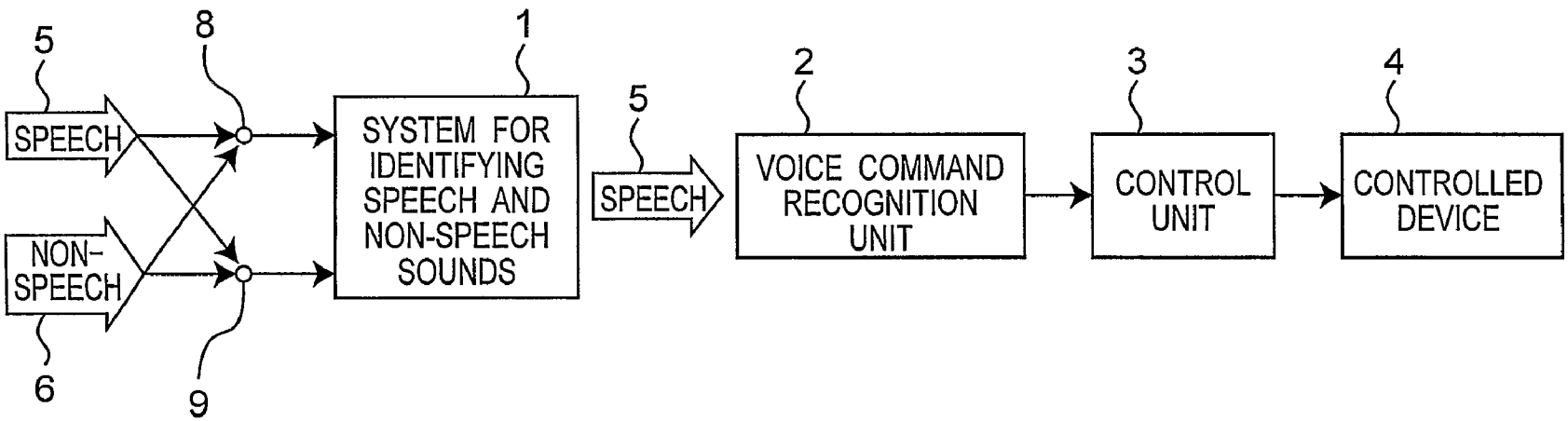
FIG. 3 is a system block diagram to illustrate an application of the system of FIG. 1 for identifying speech sound and non-speech sound in an environment according to the present invention.

Referring to FIG. 3, as described in the foregoing, the method and system 1 of this invention can be used to select and output the speech sound 5, which has the larger spectrum fluctuation between the two sound signals. Then, the speech sound 5 can be sent in sequence through a voice command recognition unit 2 and a control unit 3 so that a controlled device 4 could be voice-controlled.

In sum, the method and system 1 for identifying speech sound and non-speech sound in an environment according to the present invention uses a past spectrum storage unit 12, a spectrum fluctuation feature extractor 13, and a signal switching unit 14 to calculate spectrum fluctuation of each sound signal, and identifies one of the sound signals having a largest spectrum fluctuation as the speech sound 5. In addition, only one set of frequency-time transformation calculations is needed to transform the speech sound 5 from the frequency domain back to the time domain.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

INDUSTRIAL APPLICABILITY

The present invention can be applied to a method and system for identifying speech sound and non-speech sound in an environment.

The invention claimed is:

1. A method for identifying speech sound and non-speech sound in an environment, adapted for identifying a speech signal and other non-speech signals from a mixed sound source having a plurality of channels, said method comprising the steps of:

(a) using a blind source separation unit to separate the mixed sound source into a plurality of sound signals;

(b) storing spectrum of each of the sound signals;

(c) calculating spectrum fluctuation of each of the sound signals in accordance with stored past spectrum information and current spectrum information sent from the blind source separation unit; and (d) identifying one of the sound signals that has a largest spectrum fluctuation as the speech signal.

2. The method for identifying speech sound and non-speech sound in an environment as claimed in claim 1, wherein the blind source separation unit includes a plurality of time-frequency transformers for respectively transforming the channels of the mixed sound source from the time domain to the frequency domain, said method further comprising the step of using a frequency-time transformer for transforming the speech signal from the frequency domain to the time domain.

3. The method for identifying speech sound and non-speech sound in an environment as claimed in claim 2, wherein the time-frequency transformers are Fast Fourier Transformers, and the frequency-time transformer is an Inverse Fast Fourier Transformer.

4. The method for identifying speech sound and non-speech sound in an environment as claimed in claim 2, further comprising the steps of using a plurality of energy measuring devices for measuring and storing energies of the channels of the mixed sound source, respectively, and smoothing the speech signal in the time domain in accordance with past energy information stored in the energy measuring devices.

5. A system for identifying speech sound and non-speech sound in an environment, adapted for identifying a speech signal and other non-speech signals from a mixed sound source having a plurality of channels, said system comprising:

a blind source separation unit for separating the mixed sound source into a plurality of sound signals;

a past spectrum storage unit for storing spectrum of each of the sound signals;

a spectrum fluctuation feature extractor for calculating spectrum fluctuation of each of the sound signals in accordance with past spectrum information sent from the past spectrum storage unit and current spectrum information sent from the blind source separation unit; and a signal switching unit for receiving the spectrum fluctuations sent from the spectrum fluctuation feature extractor and for identifying one of the sound signals that has a largest spectrum fluctuation as the speech signal.

6. The system for identifying speech sound and non-speech sound in an environment as claimed in claim 5, wherein the blind source separation unit includes a plurality of time-frequency transformers for respectively transforming the channels of the mixed sound source from the time domain to the frequency domain, said system further comprising a frequency-time transformer for transforming the speech signal from the frequency domain to the time domain.

7. The system for identifying speech sound and non-speech sound in an environment as claimed in claim 6, wherein the time-frequency transformers are Fast Fourier Transformers, and the frequency-time transformer is an Inverse Fast Fourier Transformer.

8. The system for identifying speech sound and non-speech sound in an environment as claimed in claim 6, further comprising:

a plurality of energy measuring devices for measuring and storing energies of the channels of the mixed sound source, respectively; and an energy smoothing unit for smoothing the speech signal in the time domain in accordance with past energy information stored in the energy measuring devices.

* * * * *